US005732778A

United States Patent [19]

Tateno

[11] Patent Number: 5,732,778

[45] Date of Patent: Mar. 31, 1998

[54] SPRINKLER HEAD

[75] Inventor: Yukio Tateno, Tokyo, Japan

[73] Assignee: Nohmi Bosai Ltd., Tokyo, Japan

[21] Appl. No.: 501,991

[22] Filed: Jul. 13, 1995

[30] Foreign Application Priority Data

Jul. 14, 1994 [JP] Japan ..... 6-161725

[51] Int. Cl.[6] ..... A62C 37/14

[52] U.S. Cl. ..... 169/37; 169/38

[58] Field of Search ..... 169/37, 38, 39, 169/40, 41, 90

[56] References Cited

U.S. PATENT DOCUMENTS

| | | | |
|---|---|---|---|
| 266,142 | 10/1882 | Heath | 169/41 |
| 3,454,097 | 7/1969 | Groos | 169/38 |
| 4,343,364 | 8/1982 | Glinecke | 169/38 |
| 4,739,835 | 4/1988 | Polan et al. | 169/38 |
| 5,513,708 | 5/1996 | Sundholm | 169/37 |

FOREIGN PATENT DOCUMENTS

| | | |
|---|---|---|
| 28886 | of 1910 | United Kingdom . |
| 2 188 841 | 10/1987 | United Kingdom . |

*Primary Examiner*—Andrew C. Pike

*Attorney, Agent, or Firm*—Wenderoth, Lind & Ponack

[57] ABSTRACT

A sprinkler head includes a body having a water discharge port formed at the center thereof, a valve for opening and closing the water discharge port of the body, a receiver seat provided in a position opposing the valve, a heat sensitive member disposed between the valve and the receiver seat for supporting the valve, the heat sensitive member being disintegratable when heated, causing the valve to mote away from the water discharge port of the body, and a frame for supporting the receiver seat with respect to the body. To reduce directional dependency of exposure of a hot air stream to the heat sensitive member for an improvement in sensitivity of the heat sensitive member, the frame includes a plurality of y-shaped arms each having at least one draft hole formed therein and a portion inclined with respect to the heat sensitive member.

9 Claims, 9 Drawing Sheets

SPRINKLER HEAD

BACKGROUND OF THE INVENTION

1. Field of the Invention

The present invention relates to a sprinkler head which is automatically opened by heat in the event of the occurrence of fire for sprinkling water.

2. Description of the Prior Art

The above-mentioned type sprinkler head is always supplied at its water discharge port with pressurized water, and the water discharge port is closed by a valve. To provide a sufficient sealing ability in such an arrangement, a gap between the valve and the water discharge port is sealed by a copper packing. The valve is supported along with a heat sensitive member such as a low melting-point alloy or a glass bulb by a frame comprising a horseshoe-shaped arm, so that a large load is applied to ensure the sealing ability of the valve.

FIG. 13 shows a frame type sprinkler head described in Japanese Utility Model Publication No. 5-24348. This sprinkler head comprises a screw portion 22 screwed into a pipe (not shown), a pair of horseshoe-shaped frame yokes 23*a*, 23*b* having a boss 124 in opposite relation to the screw portion 22, the screw portion and the frame yokes being formed in an integral structure, and a disassemble portion 26, serving as a heat sensitive member, disposed between the boss 24 and a valve 25 closing a water discharge port. Incidentally, 27 denotes a deflector.

In the frame type sprinkler head mentioned above, if a fire occurs and a hot air stream comes into contact with the disassemble portion 26 to heat it, the disassemble portion 26 is disassembled and falls down together with the valve 25. The water discharge port is thereby opened, allowing the water in the pipe to be discharged and sprinkled to surroundings by the deflector 27.

FIG. 14 shows another frame type sprinkler head described in Japanese Utility Model Publication No. 57-3331. This sprinkler head is constituted such that a flange 32 is formed at an outer peripheral edge of a water introduction port 31 having a threaded outer peripheral surface, a valve 33 sealing the water introduction port 31 through a copper packing 34 is supported by a glass bulb 35, and arms 37*a*, 37*b* of a support 36 are inserted through the flange 32 and then fixed by nuts. Denoted by 38 is an adjustment screw provided at a lower central portion of the support 36 for not only supporting the glass bulb 35 between itself and the valve 33, but also adjusting the load imposed on the valve 33 to a predetermined value.

In the frame type sprinkler head mentioned above, if a fire occurs and a hot air stream comes into contact with the glass bulb 35, a thermally expanding agent, such as alcohol, in the glass bulb 35 is expanded and pressurized to blow up the glass bulb. The valve 33 thus falls down to open the water introduction port 31 for sprinkling water.

However, any of the foregoing conventional frame type sprinkler heads has a very low sensitivity to a hot air stream coming in directions of the frame arms. This is because a cross-sectional area of the arm must be set so large for bearing the great load imposed on the valve that a hot air stream coming in a direction of the arm 37*a* toward the glass bulb 35, for example, passes by to the opposite side without directly contacting the glass bulb 35, as shown in FIG. 15. On the other hand, since a hot air stream coming in directions perpendicular to the arms 37*a*, 37*b* directly strikes against the glass bulb 35, the glass bulb 35 operates with a normal sensitivity and blows up. Such a tendency is equally applied to the sprinkler head shown in FIG. 13. It has thus been deemed that the frame type sprinkler head inevitably has directionality in sensitivity of its heat sensitive member.

To solve the above-mentioned problem in the sprinkler head using the glass bulb 35, it is conceivable to increase a diameter of the glass bulb 35 so that a hot air stream in the arm direction may easily contact the glass bulb 35. However, this would raise the problem of increasing a wall thickness of the glass bulb 35 and hence reducing its sensitivity.

Furthermore, the heat sensitive member such as a low melting-point alloy or a glass bulb is a very important part and, if a shock is applied from the outside, the heat sensitive member would be broken, causing an unexpected accident such as a leakage of water. Because the heat sensitive member is protected by only two arms, there has been a problem that the heat sensitive member is apt to easily break upon application of external forces.

SUMMARY OF THE INVENTION

In view of solving the problems as set forth above, an object of the present invention is to provide a sprinkler head which has no directionality in sensitivity of a heat sensitive member for an improvement in the sensitivity thereof, and which can increase a function of protecting the heat sensitive member.

A sprinkler head according to the present invention comprises a body having a water discharge port formed at the center thereof, a valve for opening and closing the water discharge port of the body, a receiver seat provided in a position opposing the valve, a heat sensitive member disposed between the valve and the receiver seat for supporting the valve, the heat sensitive member being disintegrable when heated, causing the valve to move away from the water discharge port of the body, and a frame for supporting the receiver seat with respect to the body and for reducing directional dependency of exposure of a hot air stream to the heat sensitive member for an improvement in sensitivity of the heat sensitive member.

DESCRIPTION OF THE PREFERRED EMBODIMENTS

Embodiment 1

Figure 1:
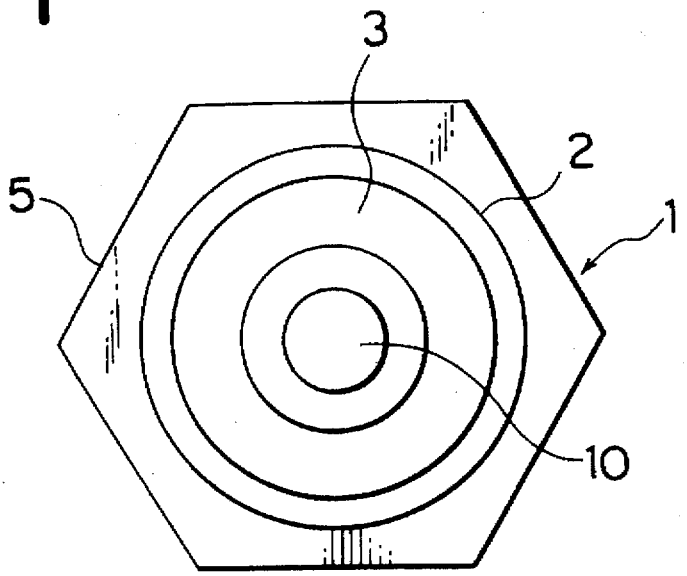
FIGS. 1 to 3 are a plan view, a front view, and a vertical sectional view showing a sprinkler head according to Embodiment 1 of the present invention, respectively.
Figure 2:
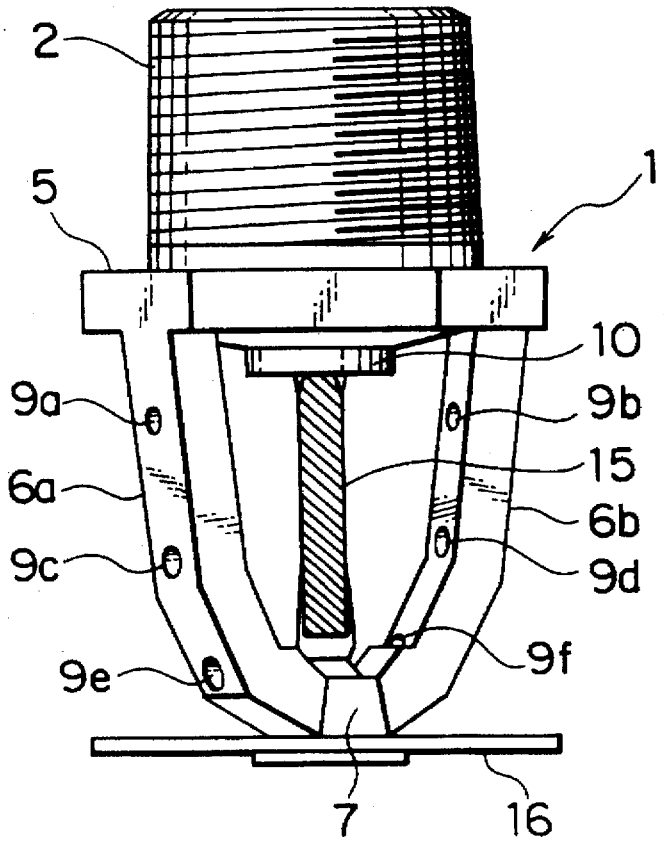
Figure 3:
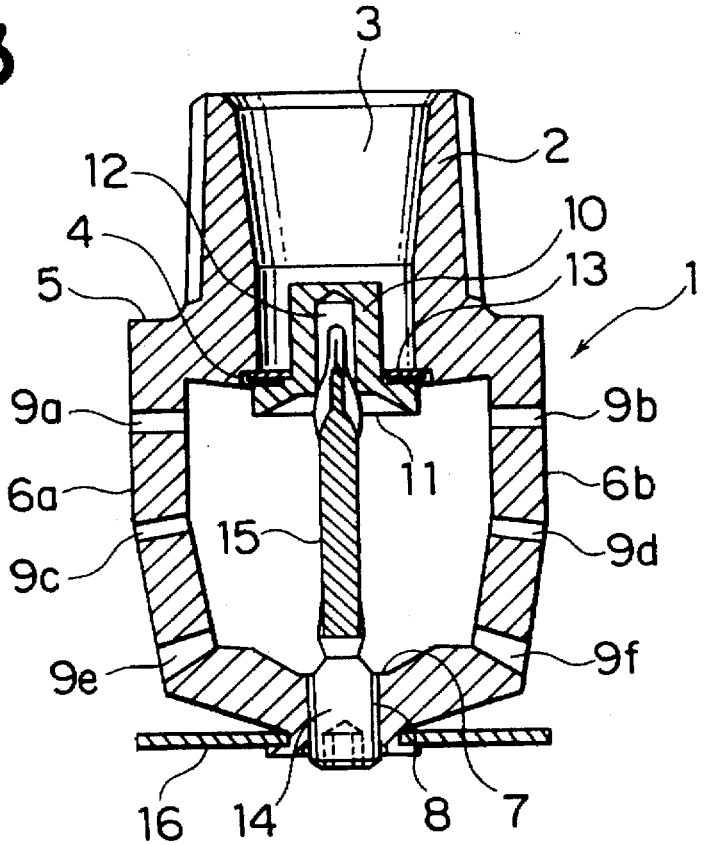

Referring to FIGS. 1 to 3, a sprinkler head body 1 comprises a screw portion 2 having a water discharge port 3 axially formed therein and male threads formed on its outer periphery, a hexagonal flange 5 formed at a lower end of the screw portion 2 in an integral structure therewith, and a pair of arms 6*a* and 6*b* extending downwardly from a lower surface of the flange 5 in opposite relation to each other. As shown in FIG. 3, the body 1 has a recess 4 formed along an inner peripheral wall defining a lower end of the water discharge port 3. The arms 6*a* and 6*b* are provided in positions opposed to each other with draft holes 9*a* to 9*f* penetrating the arms toward a central axis of the body 1, and have respective lower ends coupled together on the central axis of the body 1 to form a receiver seat 7. Note that the flange 5 is not necessarily limited in its shape to a hexagon, but it may be formed into a disk-like shape, for example, with engagement portions provided on an outer periphery thereof which is to be engaged with an attaching/detaching tool.

A valve 10 is configured such that a disk-like flange is radially extended from a lower end of a column. A recess 11 is formed on a lower surface of the flange, and a bottom-equipped guide hole 12 opening to the recess 11 is formed to extend along a central axis of the valve. The flange of the valve 10 has a diameter slightly larger than that of the water discharge port 3 of the body 1, and is held in abutment against the recess 4 of the body 1 with the intervention of a packing 13 made of elastic materials therebetween.

A threaded hole 8 is formed in the receiver seat 7 of the body 1 to extend in the axial direction of the body 1, and a setting screw 14 is screwed into the threaded hole 8. Between the valve 10 and the setting screw 14, there is held a glass bulb 15 which is filled with a thermally expanding agent, such as alcohol. A deflector 16 is attached to a lower end of the receiver seat 7.

A sprinkler head comprising the above-mentioned components such as the body 1, the valve 10, the setting screw 14, and the glass bulb 15 is assembled by first inserting the column portion of the valve 10 into the water discharge port 3 of the body 1 through an open space between the arms 6*a* and 6*b* with the intervention of a packing 13 therebetween. Then, the setting screw 14 is loosened and a distal end portion of the glass bulb 15 is inserted into the guide hole 12 of the valve 10, while the glass bulb 15 is held at an opposite end by the setting screw 14. By screwing the setting screw 14 into the threaded hole 8, the glass bulb 15 is fixedly supported between the valve 10 and the setting screw 14. In this connection, the load imposed on the glass bulb 15 is adjusted by changing the amount through which the setting screw 14 is screwed into the threaded hole 8.

The sprinkler head thus assembled is attached to a ceiling surface by screwing the screw portion 2 into a water supply pipe provided in the ceiling. At this time, a great load is imposed on the valve 10 by pressurized water introduced through the water supply pipe, but there is no fear of leakage of the pressurized water because the valve 10 is held in place by the glass bulb 15 interposed between itself and the setting screw 14 and the gap between the body 1 and the valve 10 is sealed by the packing 13 made of elastic materials.

If a fire occurs and a hot air stream is produced, the hot air stream moves upwardly, passes through the open space between the arms 6*a* and 6*b*, and then contacts the glass bulb 15 to heat it. When the hot air stream comes closer while flowing in the direction of the arm 6*a* (or 6*b*) toward the glass bulb 15, it passes through the draft holes 9*a*, 9*c*, 9*e* (or 9*b*, 9*d*, 9*f*) provided in the arms 6*a* (or 6*b*), and then contacts the glass bulb 15. Therefore, the presence of the arms 6*a*, 6*b* gives rise to no appreciable undesired effect.

If the glass bulb 15 is heated by the hot air stream, the thermally expanding agent filled therein is expanded and pressurized to blow up the glass bulb 15 supporting the valve 10. The valve 10 falls down through the space between the arms 6*a* and 6*b* to open the water discharge port 3 so that the pressurized water is discharged and sprinkled through the deflector 16.

Generally, the hot air stream in the vicinity of the ceiling flows along the ceiling, and the hot air stream in lower part flows toward the ceiling. Therefore, the hot air stream can more smoothly pass through the draft holes by forming them such that the draft holes 9*a*, 9*b* provided in upper portions of the arms 6*a*, 6*b* are substantially parallel to the ceiling surface, whereas the draft holes 9*c*, 9*d*, 9*e*, 9*f* provided in middle and lower portions of the arms 6*a*, 6*b* are inclined downwardly.

Thus, with this embodiment, since the plurality of draft holes 9*a* to 9*f* allowing the hot air stream to pass therethrough are provided in the arms 6*a*, 6*b*, a heat sensitive member, i.e., the glass bulb 15, has no appreciable directionality in sensitivity and hence has an improved sensitivity.

As a modification, the arms 6*a*, 6*b* may have a ladder-like shape by forming the arms 6*a*, 6*b* in a wider width and increasing the size of the draft holes 9*a* to 9*f* so as to cover the glass bulb 15 by the arms in a larger circumferential range. This makes it possible to increase a function of protecting the glass bulb 15. Further, the draft holes 9*a* to 9*f* may be joined to each other into the slit form for each arm.

Embodiment 2

Figure 4:
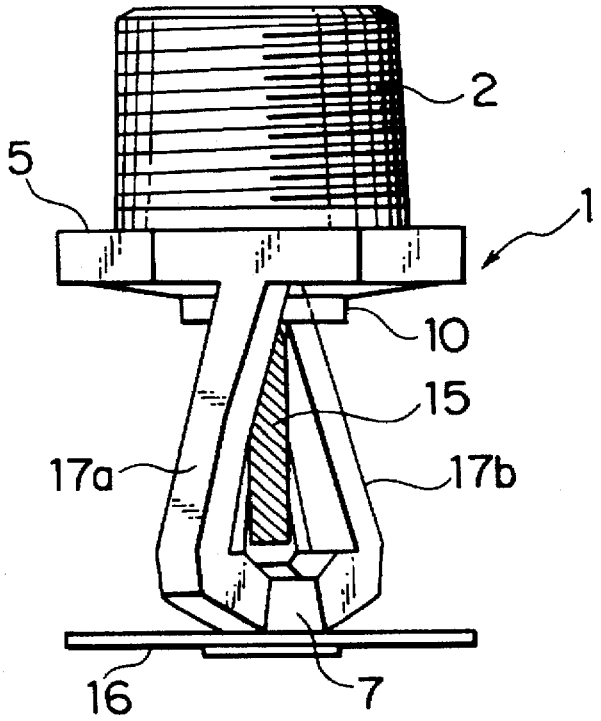
FIG. 4 is a side view showing a sprinkler head according to Embodiment 2.

FIG. 4 shows a sprinkler head according to Embodiment 2. Note that the same parts as those in Embodiment 1 are denoted by the same reference numerals and will not be described here. In this embodiment, a pair of opposing arms 17*a*, 17*b* are provided in an integral structure with the screw portion 2 and the flange 5, and are twisted in opposite directions (inclined with respect to the glass bulb 15), lower ends of the arms being coupled together to the receives seat 7.

With this embodiment thus arranged, since the pair of opposing arms 17*a*, 17*b* are inclined in opposite directions with respect to the glass bulb 15, the glass bulb 15 is not entirely concealed by the arms 17*a*, 17*b* in any direction. Accordingly, even if a hot air stream produced by a fire comes closer in any direction, it is not totally blocked by the arms 17*a*, 17*b* and contacts the glass bulb 15 to heat it. As a result, it is possible to eliminate directionality in sensitivity of the heat sensitive member and hence improve a sensitivity thereof.

Although the arms 17*a*, 17*b* are inclined in opposite directions with respect to the glass bulb 15 in the illustrated embodiment, they may be inclined in the same direction with respect to the glass bulb 15.

Embodiment 3

Figure 5:
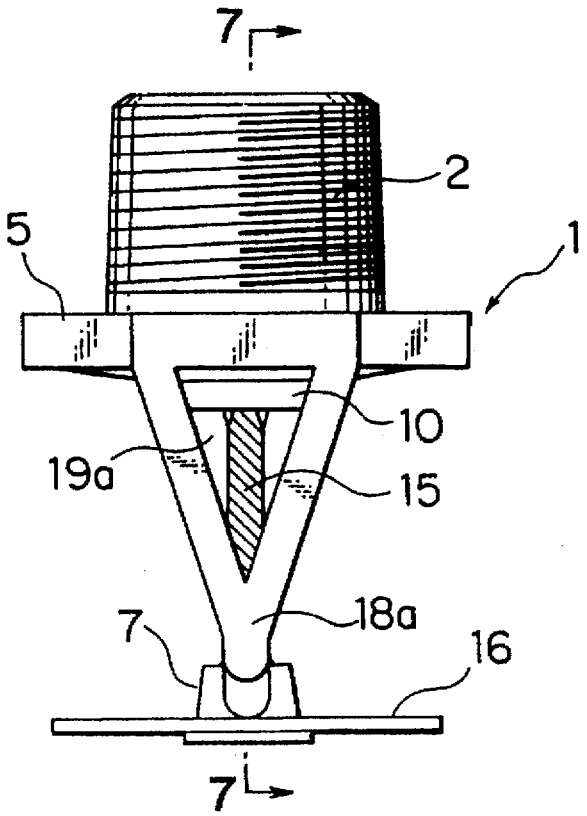
FIGS. 5 and 6 are a front view and a perspective view showing a sprinkler head according to Embodiment 3, respectively.
Figure 6:
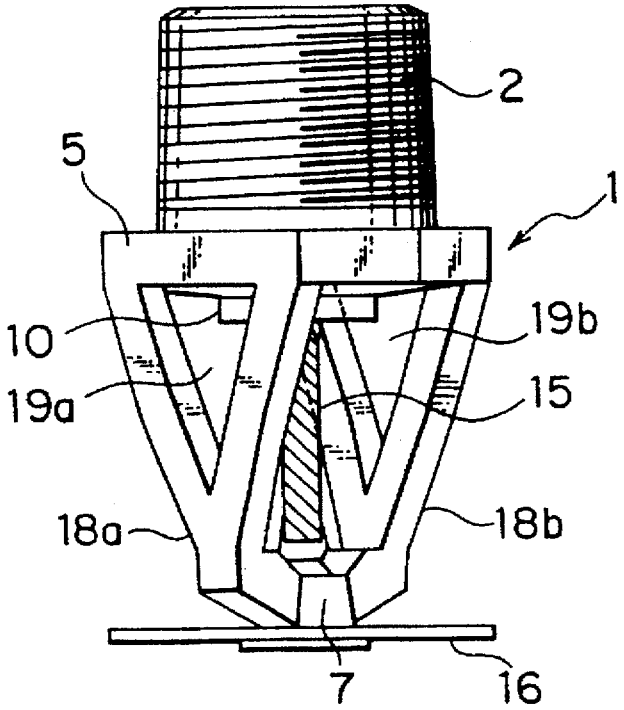
Figure 7:
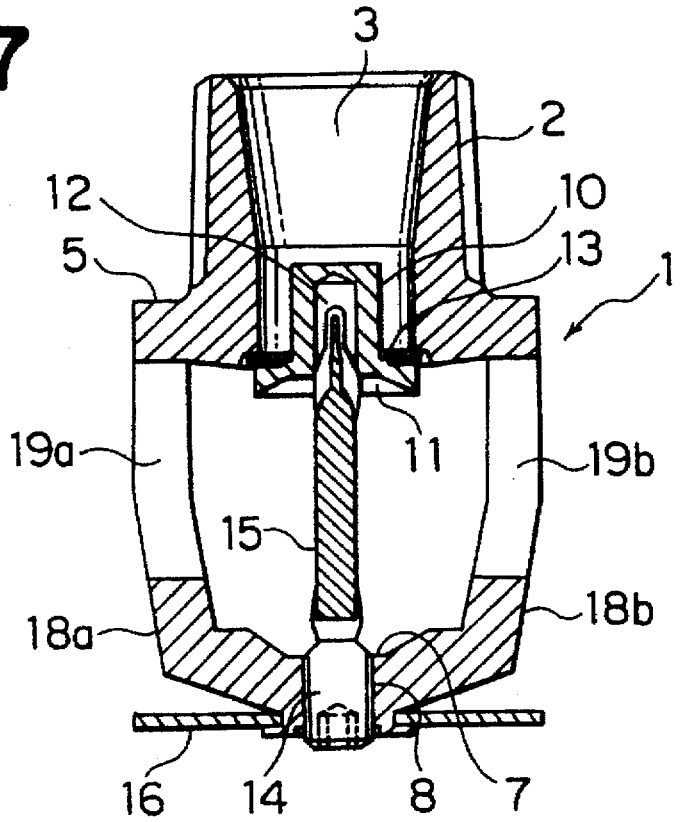
FIG. 7 is a sectional view taken along line 7—7 in FIG. 5.

FIGS. 5 to 7 show a sprinkler head according to Embodiment 3. Note that the same parts as those in Embodiments 1 and 2 are denoted by the same reference numerals and will not be described here. In this embodiment, a pair of opposing arms 18*a*, 18*b* are formed in a substantially Y- or V-shape, the arms having upper ends joined together to the screw portion 2 and lower ends coupled together to the receiver seat 7.

With this embodiment, since the arms 18*a*, 18*b* are formed in a substantially Y- or V-shape, a hot air stream produced by a fire and coming closer in a direction of the arm 18*a* or 18*b* toward the glass bulb 15 passes through a void 19*a* or 19*b* defined in the arm 18*a* or 18*b* and contacts the glass bulb 15 to heat it without being undesirably affected by the arm 18*a* or 18*b*. Also, for a hot air stream coming closer in a direction vertical to the drawing sheet of FIG. 6, a similar effect to that in the above Embodiment 2 can be obtained because the arms 18*a*, 18*b* are inclined. It is thus possible to eliminate directionality in sensitivity of the heat sensitive member and hence improve a sensitivity thereof.

Further, since the arms 18*a*, 18*b* cover the glass bulb 15 in a larger circumferential range, a function of protecting the glass bulb can be increased.

Figure 14:
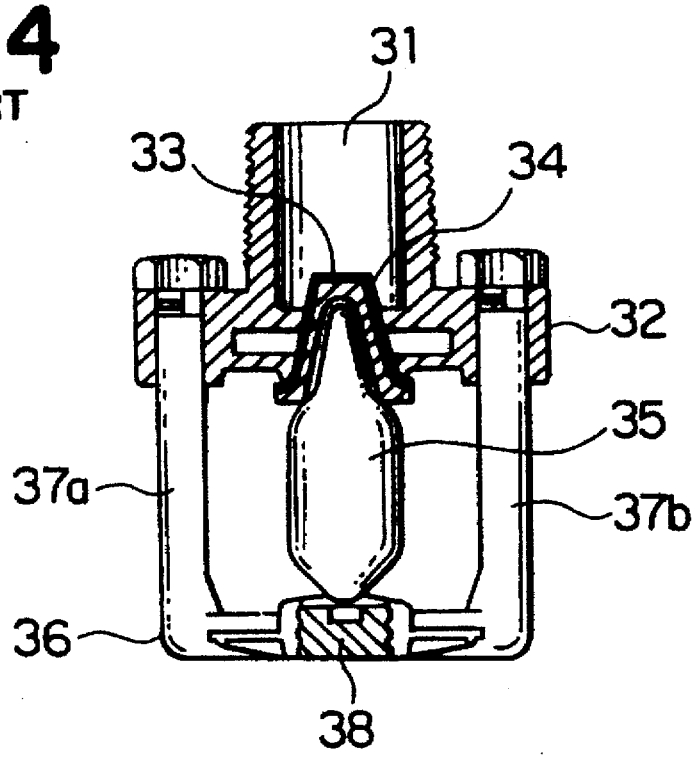
FIG. 14 PRIOR ART
FIG. 14 is a front view showing another conventional sprinkler head.
Figure 15:
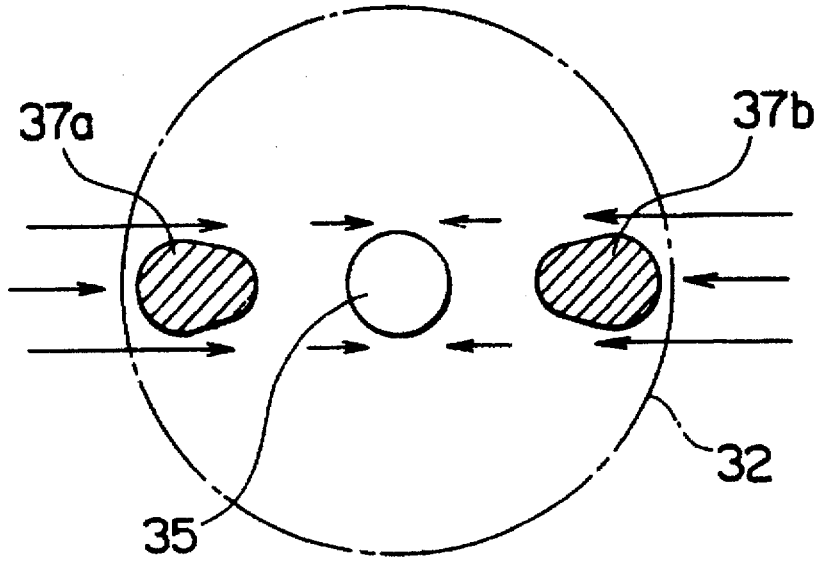
FIG. 15 PRIOR ART
FIG. 15 is a diagram for explaining operation of the sprinkler head of FIG. 14.

Next, test results of the conventional frame type sprinkler head shown in FIG. 14 and the sprinkler head of this embodiment having the Y-shaped arms 18*a*, 18*b* are shown in TABLE 1 below. The test was conducted by setting each of the sprinkler heads in an atmosphere with temperature of 100 (°C.) and wind velocity of 1.5 (m/s), and measuring a time constant of a curve plotted on condition that the horizontal axis represents time and the vertical axis represents temperature.

TABLE 1

| | Hot air stream sent in direction of arm | Hot air stream sent in direction perpendicular to arm |
|---|---|---|
| Conventional type | 342.8 | 56.4 |
| Embodiment | 77.6 | 31.5 |

As is apparent from the values measured for the conventional type in TABLE 1, when a hot air stream is sent in a direction of the arm toward the glass bulb, the time constant value is about six times as large as the value resulted when a hot air stream is sent in a direction perpendicular to the arm toward the glass bulb. In other words, it is found that the sensitivity is remarkably different depending on directions and is much reduced for the hot air stream coming closer in the direction of the arm toward the glass bulb.

By contrast, in this embodiment, the difference between the two measured values can be held down on the order of twice and, hence, directionality in sensitivity can substantially be eliminated.

Although the body 1 is constructed by forming the arms 6*a*, 6*b*; 17*a*, 17*b*; or 18*a*, 18*b* in an integral structure with the flange 5 in the above. Embodiments 1 to 3, it may be constructed by forming the arms 6*a*, 6*b*; 17*a*, 17*b*; or 18*a*, 18*b* as separate members. In this case, the body 1 may be constituted by threading respective upper end portions of the arms 6*a*, 6*b*; 17*a*, 17*b*; or 18*a*, 18*b*, inserting the threaded portions into insertion holes bored through the flange 5, and fastening bolts or the like over the threaded portions, as with the prior art shown in FIG. 14, or by providing an annular tube at upper ends of the arms 6*a*, 6*b*; 17*a*, 17*b*; or 18*a*, 18*b* so as to interconnect the pair of arms, threading an inner (or outer) peripheral wall of the annular tube and an outer (or inner) peripheral wall of the flange, and fixedly screwing the arms to the flange through the threaded portions.

Embodiment 4

Figure 8:
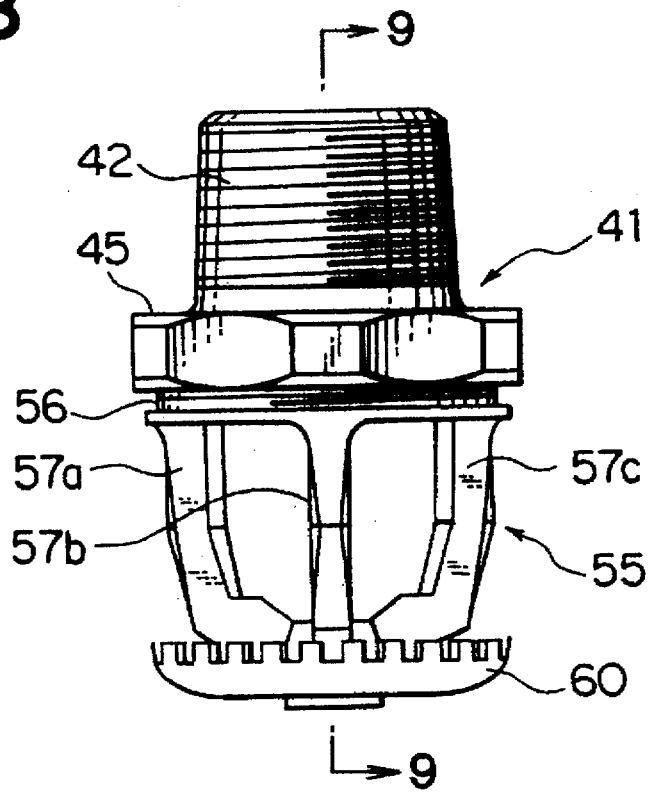
FIG. 8 is a front view showing a sprinkler head according to Embodiment 4.
Figure 9:
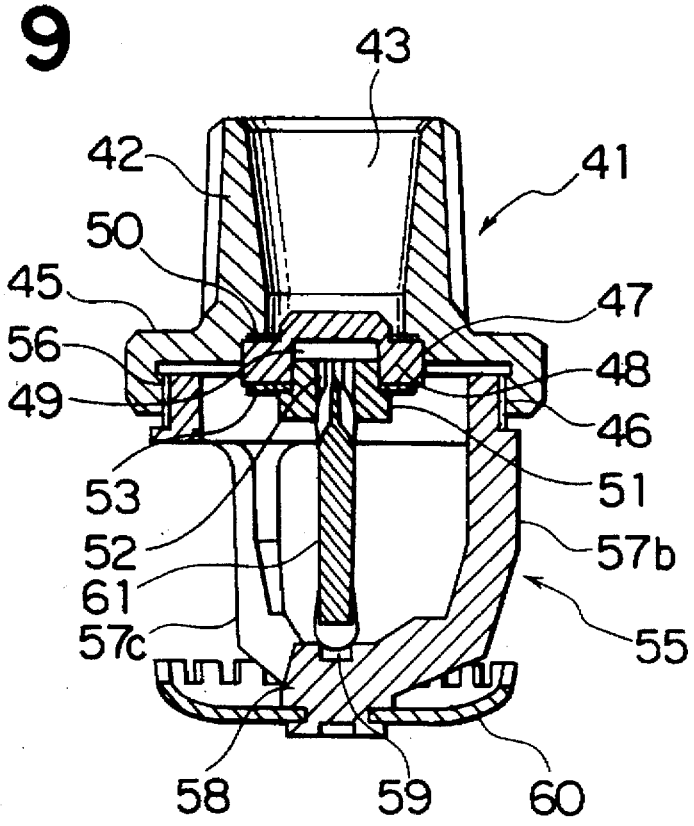
FIG. 9 is a sectional view taken along line 9—9 in FIG. 8, FIGS. 10 and 11 are an exploded perspective view and a horizontal sectional view showing a sprinkler head according to Embodiment 4, respectively.

FIGS. 8 and 9 show a sprinkler head according to Embodiment 4. A sprinkler head body 41 comprises a screw portion 42 having a water discharge port 43 axially formed therein and male threads formed on its outer periphery, and a flange 45 formed at a lower end of the screw portion 42 in an integral structure therewith and having engagement portions provided on an outer periphery for an attaching/detaching tool. The flange 45 has female threads 46 formed on its inner peripheral surface, and also has a recess 47 formed at the axial center thereof having a larger diameter than that of the water discharge port 43.

Denoted by 48 is a convex valve comprising a large-diameter portion and a small-diameter portion. The large-diameter portion is formed to be capable of fitting to the recess 47 of the body 41, and has a cylindrical recess 49 defined at the center of its lower surface. 50 is a seal packing formed by coating a fluororesin over a belleville spring made of, for example, ring-shaped metal materials (spring steel) such as iron and stainless steel. Incidentally, a packing made of a fluororesin may be used instead of the packing formed by coating a fluororesin over metal materials.

Denoted by 51 is a convex valve guide having a penetration hole 52 defined through the center thereof and comprising a large-diameter portion and a small-diameter portion, the small-diameter portion being formed to be fitted to the recess 49 of the valve 48. 53 is a belleville spring for adjusting the load, which is interposed between the valve 48 and the valve guide 51 as shown in FIG. 9 if the seal packing 50 is not used as a belleville spring. Alternatively, if a belleville spring is used as the seal packing 50, the valve 48 and the valve guide 51 may be formed in an integral structure by omitting the belleville spring 53.

Denoted by 55 is a frame which has, on an outer periphery of its one end, a male thread portion 56 in the form of a ring to be engaged with the female threads 46 provided in the flange 45 of the body 41, and also has three arms 57*a*, 57*b*, 57*c* extending downwardly from a lower surface of the male thread portion 56 at equal intervals (120°) therebetween. The arms 57*a* to 57*c* are bent in respective lower portions toward the central axis of the frame 55 and are joined together to form a receiver seat 58. 59 is a support portion provided in the receiver seat 58 for supporting a glass bulb 61 described later. Incidentally, the arms 57*a* to 57*c* are each formed to have a rectangular or elliptical cross-section being elongated in a direction toward the central axis of the frame 55.

Denoted by 60 is a deflector attached to a lower end of the frame 55, and 61 is a columnar glass bulb which is filled with a thermally expanding agent, such as alcohol, the glass bulb having a thinned distal end portion. The intervals between the arms 57*a* to 57*c* of the frame 55 are selected to such an extent that the valve 48 surely falls down when the glass bulb 61 is blown up. Since the frame 55 comprises the three arms 57*a* to 57*c*, a cross-sectional area of each of the arms 57*a* to 57*c* can be set smaller than that in the case of using only two arms. In the illustrated embodiment, the width of each of the arms 57*a* to 57*c* is set to about 4 mm.

Figure 10:
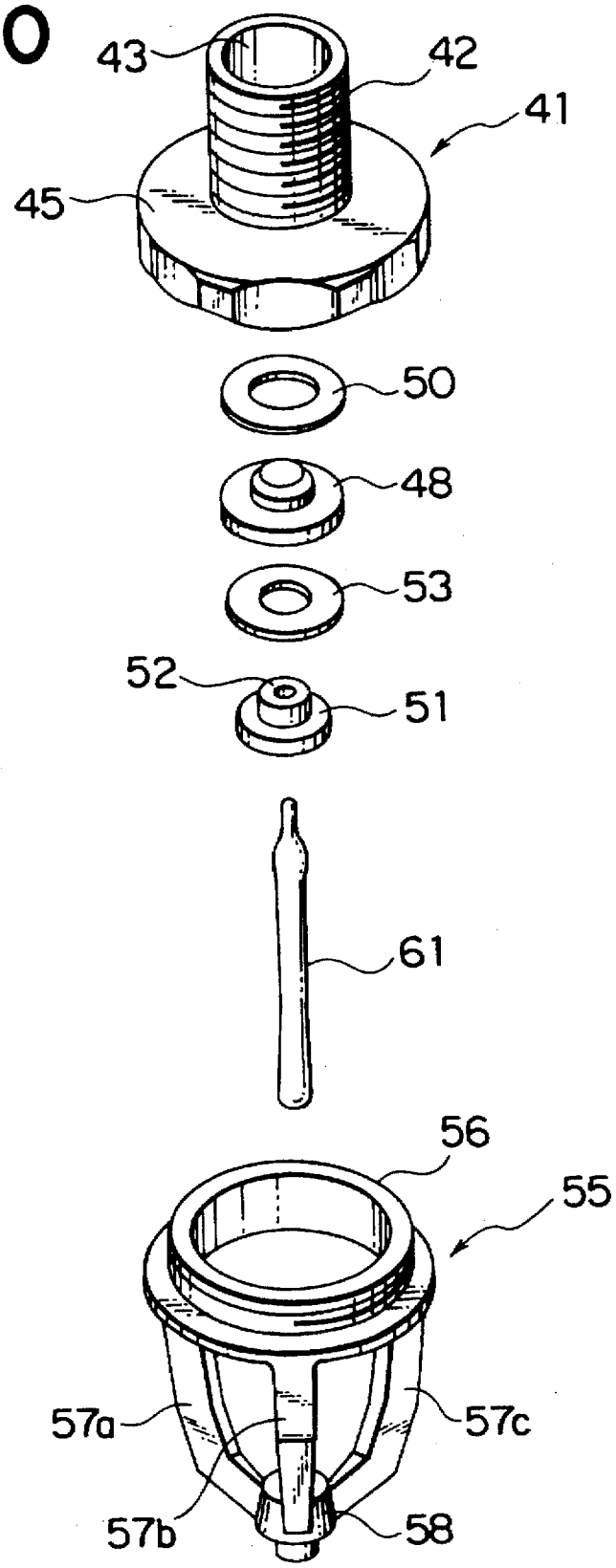

The sprinkler head comprising the above-mentioned parts is assembled as shown in FIG. 10. The valve 48 is first fitted into the recess 47 of the body 41 with the intervention of the packing 50 coated by a fluororesin therebetween. The small-diameter portion of the valve guide 51 is then fitted into the recess 49 of the valve 48 with the intervention of the belleville spring 53 urging downwardly therebetween. Under this condition, the male thread portion 56 of the frame 55 is tentatively screwed into the female threads 46 of the body 41, and the distal end portion of the glass bulb 61 is inserted into the penetration hole 52 of the valve guide 51 while the opposite end thereof is fitted into the support portion 59 of the frame 55.

Subsequently, by screwing the male thread portion 56 of the frame 55 into the female threads 46 of the body 41, the glass bulb 61 is supported between the valve guide 51 and the frame 55, and the body 41 and the frame 55 are coupled together. In this connection, the load imposed on the glass bulb 61 is adjusted by changing the amount through which the frame 55 is screwed into the body 41. As a modification, the distal end portion of the glass bulb 61 may directly be supported by the valve 48 by omitting the valve guide 51.

The sprinkler head thus assembled is attached to a ceiling surface by screwing the screw portion 42 into a water supply pipe provided in the ceiling. At this time, a great load is imposed on the valve 48 by pressurized water introduced through the water supply pipe, but there is no fear of leakage of the pressurized water because the valve 48 is held in place by the glass bulb 61 interposed between the valve guide 51 and the support portion 59 of the receiver seat 58 while the gap between the body 41 and the valve 48 is sealed by the packing 50 coated with a fluororesin having high elasticity.

Figure 11:
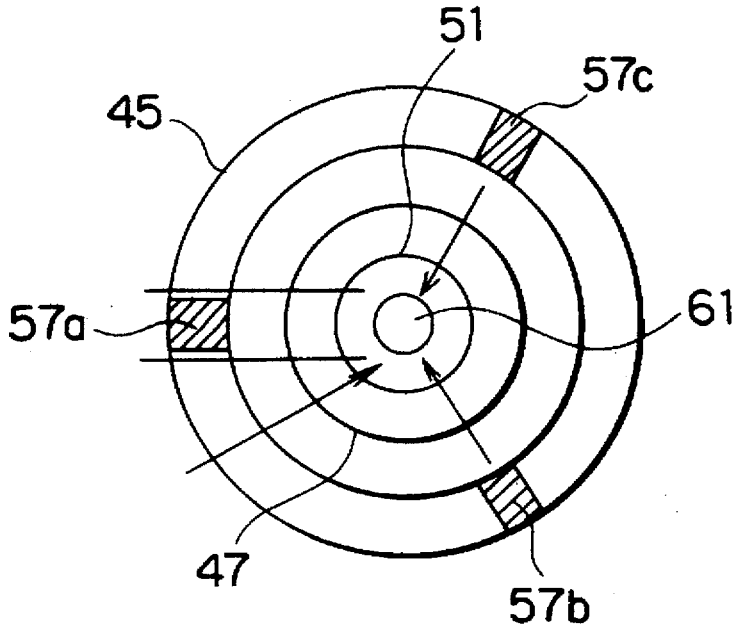

If a fire occurs and a hot air stream is produced, the hot air stream passes through open spaces between the arms 57*a* to 57*c* of the frame 55 and then contacts the glass bulb 61 to heat it, as shown in FIG. 11. On this occasion, since the arms 57*a* to 57*c* each have a small cross-sectional area as mentioned above, undesirable influences caused by the presence of the arms 57*a* to 57*c* are small. Also, since the arms 57*a* to 57*c* are provided with equal intervals, part of the hot air stream comes closer in the direction of the arm 57*a*, for example, strikes against rear sides (reflecting surfaces) of the other arms 57*b*, 57*c* and is reflected by them to contact the glass bulb 61, thereby accelerating the heating of the glass bulb 61. As a result, the glass bulb 61 has no directionality in its sensitivity and becomes more sensitive.

If the glass bulb 61 is heated by the hot air stream and the thermally expanding agent filled therein is expanded and pressurized to blow up the glass bulb 61, the valve 48 falls down while passing among the arms 57*a* to 57*c*, causing the water to be discharged from the water discharge port 43 and sprinkled through the deflector 60.

Next, test results of the conventional frame type sprinkler head, shown in FIG. 14, having two arms and the sprinkler head of this embodiment are shown in TABLE 2 below. The test was conducted by setting each of the sprinkler heads in an atmosphere with temperature of 100 (°C.) and wind velocity of 1.5 (m/s), and measuring a time constant of a curve plotted on condition that the horizontal axis represents time and the vertical axis represents temperature.

TABLE 2

| | Hot air stream sent in direction of arm | Hot air stream sent in direction perpendicular to arm |
|---|---|---|
| Conventional type | 342.8 | 56.4 |
| Embodiment | 143.5 | 56.1 |

As is apparent from the values measured for the conventional type in TABLE 2, when a hot air stream is sent in a direction of the arm, the time constant value is about six times as large as the value resulted when a hot air stream is sent in a direction perpendicular to the arm. In other words, it is found that the sensitivity is remarkably different depending on directions and is much reduced for the hot air stream coming closer in the direction of the arm.

By contrast, in this embodiment, the difference between the two measured values can be held down on the order of 2.5 times and, hence, directionality in sensitivity can substantially be eliminated.

Figure 16:
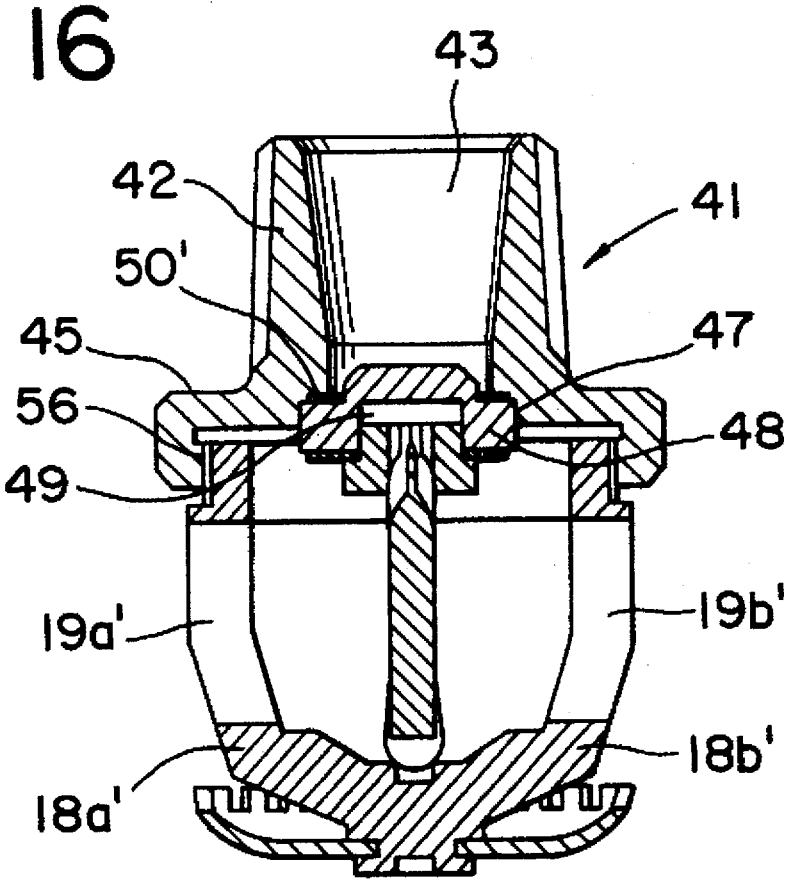
FIG. 16 is a sectional view similar to FIG. 7 but including features of FIG. 9 and also showing a fluororesin packing.

As shown in FIG. 16, the two piece threaded assembly of FIG. 9, including a body with a threaded portion and a Y-shaped frame as shown in FIG. 7 may be employed. Such frame has arms 18*a*' and 18*b*' having therethrough voids 19*a*' and 19*b*'. Such arrangement further can have a packing 50' formed of a fluororesin.

Embodiment 5

Figure 12:
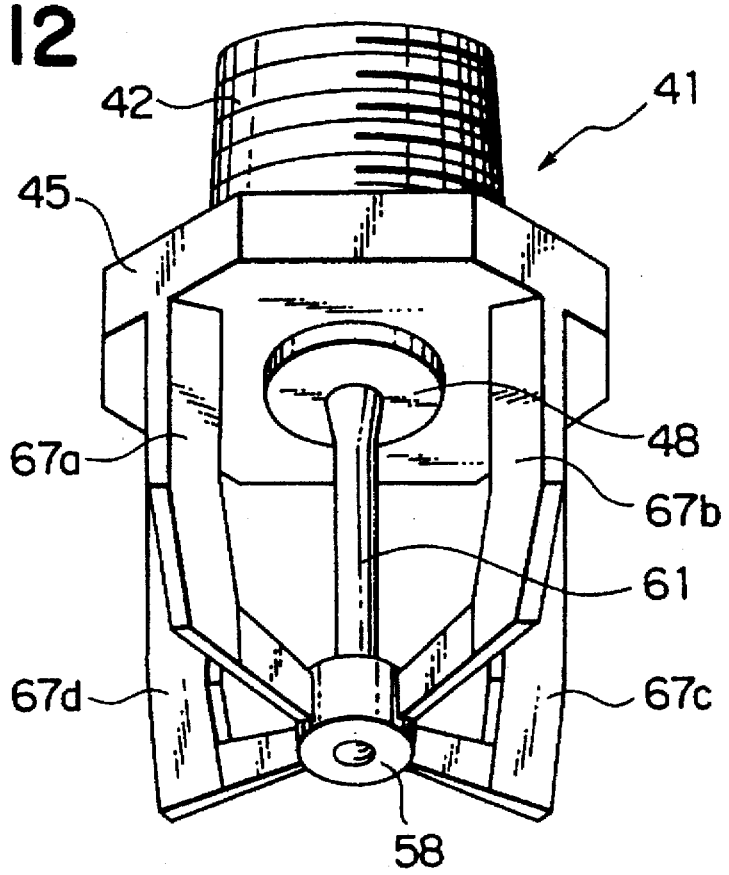
FIG. 12 is a perspective view showing a sprinkler head according to Embodiment 5.

FIG. 12 shows a sprinkler head according to Embodiment 5. In this embodiment, four arms 67*a*, 67*b*, 67*c*, 67*d* are provided at equal intervals therebetween instead of the arms 57*a* to 57*c* in Embodiment 4. With the increased number of arms 67*a* to 67*d*, the thickness (or diameter) of each arm can be reduced (thinned) in comparison with that in the case of using three arms, which is effective to eliminate directionality in sensitivity and increase a function of protecting the glass bulb 61.

Also, in this embodiment, the arms 67*a* to 67*d* are each formed to have an elongate rectangular cross section, and a side face of each arm defined by the longer side of the cross section serves as a reflecting surface to reflect a hot air stream coming closer in a direction of the adjacent arm toward the glass bulb 61. For example, a hot air stream flowing toward the glass bulb 61 in a direction of the arm 67*b* strikes against the reflecting surfaces of the arms 67*a*, 67*c* and is divided into two streams by each reflecting surface such that one flows outwardly, but the other flows toward the glass bulb 61 to efficiently heat it.

Although the body is formed in an integral structure with the frame in Embodiment 5 shown in FIG. 12, the body and the frame may be separatedly formed and be joined together by screw fitting, as in Embodiment 4.

In Embodiments 4 and 5, since three or four arms are provided, the function of protecting the heat sensitive member (glass bulb) disposed inside the arms can be increased.

Since the body and the frame are joined together by screw fitting and the load imposed on the valve and the heat sensitive member is adjusted by the screwing operation, it is possible to easily assemble the valve and the heat sensitive member, dispense with an additional screw for adjusting the load, and reduce the number of parts.

In spite of the frame having a rather complex structure, since the frame is made separate from the body and is joined thereto by screw fitting, the mold structure is simplified, resulting in that a large number of frames can be molded by a single process and a remarkable cost reduction can be achieved.

Since the heat sensitive member is formed of a glass bulb and a highly elastic packing formed by coating a fluororesin over metal materials is interposed between the body and the valve, the valve can positively be sealed by a relatively small load (about 40 kgf).

Therefore, a glass bulb which has a small resisting load and hence which is thin and has a small diameter (outer diameter of 3 mm in the illustrated embodiments) can be used, which results in an improved sensitivity.

Although three or four arms are provided on the frame in Embodiments 4 and 5, five or more arms may be provided so long as the valve can surely fall down while passing among the arms.

Although the valve is allowed to more easily fall down through between the arms by providing the arms at equal intervals therebetween, the arms are not necessarily provided at equal intervals if another measure such as reducing the valve size is achieved.

Figure 13:
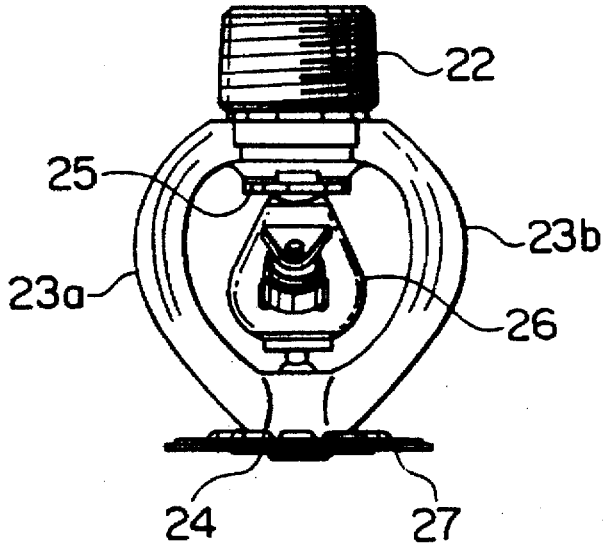
FIG. 13 PRIOR ART
FIG. 13 is a front view showing a conventional sprinkler head.

While the above description is made as constructing the body comprising the screw portion and the flange separately from the frame comprising the male thread portion, the arms and the receiver seat and joining the body and the frame together by screw fitting, the present invention is not limited to such arrangements. The present invention is also applicable to, for example, the sprinkler head shown in FIG. 13 in which the screw portion and the frame are formed in an integral structure, or the sprinkler head shown in FIG. 14 in which the arms of the frame are inserted through the flange and fixed by nuts. In these case, however, a setting screw for supporting the heat sensitive member and adjusting the load is required to be provided in the receiver seat.

In the case of inserting the arms through the flange and fixing them by nuts, load adjustment is troublesome due to the necessity of evenly tightening three nuts on the flange, and the flange size must be increased correspondingly to the nut size. The necessity of providing threads in upper portions of the arms brings about another problem of increasing the arm length.

While the foregoing Embodiments 1 to 5 are described as applying the present invention principally to frame type sprinkler heads using heat sensitive members formed of glass bulbs, the present invention can also be applied to other frame type sprinkler heads using low melting-point alloys or the like.

What is claimed is:

1. A sprinkler head comprising:

a body having a water discharge port formed at a center thereof;

a valve for opening and closing the water discharge port of said body, a receiver seat provided in a position opposing said valve, a heat sensitive member disposed between said valve and said receiver seat for supporting said valve, said heat sensitive member being disintegrable when heated, causing said valve to move away from the water discharge port of said body, and a frame for supporting said receiver seat with respect to said body and for reducing directional dependency of said heat sensitive member when exposed to a hot air stream to improve sensitivity thereof, said frame including a plurality of Y-shaped arms supporting said receiver seat and each having at least one draft hole formed therein through which the hot air stream flows toward said heat sensitive member.

2. A sprinkler head according to claim 1 wherein each of said arms includes a portion inclined with respect to said heat sensitive member.

3. A sprinkler head according to claim 1 wherein said frame is formed in an integral structure with said body.

4. A sprinkler head according to claim 1 wherein said body has a first threaded portion, said frame having a second threaded portion screwed into said first threaded portion of said body.

5. A sprinkler head according to claim 1 further comprising a seal packing interposed between said body and said valve.

6. A sprinkler head according to claim 5 wherein said seal packing is made of a fluororesin.

7. A sprinkler head according to claim 5 wherein said seal packing is made of elastic material.

8. A sprinkler head according to claim 1 wherein said heat sensitive member is formed of a glass bulb.

9. A sprinkler head according to claim 1 further comprising a deflector fixed to said frame.

* * * * *